US005546748A

United States Patent [19]

Iwai et al.

[11] Patent Number: 5,546,748

[45] Date of Patent: Aug. 20, 1996

[54] EXHAUST SYSTEM FOR OUTBOARD MOTOR

[75] Inventors: Tomio Iwai; Seiichi Tanaka, both of Hamamatsu, Japan

[73] Assignee: Sanshin Kogyo Kabushiki Kaisha, Hamamatsu, Japan

[21] Appl. No.: 159,056

[22] Filed: Nov. 29, 1993

[30] Foreign Application Priority Data

Nov. 27, 1992 [JP] Japan ..... 4-341498

[51] Int. Cl.[6] ..... F01N 3/28

[52] U.S. Cl. ..... 60/302; 60/298; 60/323

[58] Field of Search ..... 60/299, 302, 323, 60/298; 422/180

[56] References Cited

U.S. PATENT DOCUMENTS

| | | | |
|---|---|---|---|
| 3,302,394 | 2/1967 | Pahnke et al. | 60/302 |
| 3,644,098 | 2/1972 | De Palma et al. | 60/302 |
| 3,927,525 | 12/1975 | Jacobs | 60/302 |
| 4,023,361 | 5/1977 | Kojima | 60/302 |
| 4,372,111 | 2/1983 | Virk et al. | 60/274 |
| 4,735,046 | 5/1988 | Iwai | 60/295 |
| 4,772,236 | 9/1988 | Laimböck | 60/302 |
| 5,014,510 | 5/1991 | Laimböck | 60/302 |
| 5,280,708 | 1/1994 | Sougawa et al. | 60/302 |
| 5,346,417 | 9/1994 | Isogawa | 60/302 |

FOREIGN PATENT DOCUMENTS

| | | | |
|---|---|---|---|
| 473081 | 3/1992 | European Pat. Off. | 60/302 |
| 3018277 | 5/1980 | Germany . | |
| 52-8932 | 3/1977 | Japan . | |
| 0118912 | 9/1979 | Japan | 60/299 |
| 62-28288 | 1/1980 | Japan . | |
| 55-12233 | 1/1980 | Japan . | |
| 55-100430 | 1/1980 | Japan . | |
| 59-41199 | 2/1980 | Japan . | |
| 60-3039 | 2/1980 | Japan . | |
| 55-22544 | 2/1980 | Japan . | |
| 57-150099 | 9/1982 | Japan . | |
| 57-203814A | 12/1982 | Japan . | |
| 3061606 | 3/1991 | Japan | 60/302 |
| 3085320 | 4/1991 | Japan | 60/299 |
| 2245506 | 1/1992 | United Kingdom | 60/302 |

*Primary Examiner*—Leonard E. Heyman
*Attorney, Agent, or Firm*—Knobbe, Martens, Olson & Bear

[57] ABSTRACT

A number of embodiments of exhaust systems for outboard motors including a combined catalyst bed and exhaust manifold forming member affixed within the cylinder block of the engine so as to be readily detachable for servicing. This combined member is provided with a separate cooling jacket for its cooling.

29 Claims, 9 Drawing Sheets

EXHAUST SYSTEM FOR OUTBOARD MOTOR

BACKGROUND OF THE INVENTION

This invention relates to an exhaust system for an outboard motor and more particularly to an improved catalytic exhaust system for an outboard motor.

The desirability of catalytic exhaust systems for internal combustion engines to reduce the emission of unwanted exhaust gas constituents to the atmosphere is well known. A particular application where it is desirable to employ such exhaust systems is in connection with outboard motors. With outboard motors, there is a danger that the exhaust gases can pollute not only the atmosphere but the body of water in which the watercraft is operating since most outboard motors employ, as a form of exhaust treatment and silencing, the discharge of the exhaust gases to the atmosphere through the body of water in which the watercraft is operating. With many types of catalysts, it is desirable to position the catalyst bed as close to the exhaust ports of the engine as possible. This is because the temperature there will be the highest and many catalysts require an elevated temperature to promote the treatment of the exhaust gases. However, such close positioning of the catalyst to the exhaust ports does present certain difficulties.

In the first instance, it is difficult to service the catalyst bed when it is positioned in either the cylinder head or cylinder block, whichever forms the exhaust ports for the engine. In addition to this problem, if the catalyst is too close to the exhaust port, then the heat from the catalyst can actually cause damage to the internal components of the engine, particularly the pistons.

It is, therefore, a principal object of this invention to provide an improved and simplified catalytic exhaust system for an internal combustion engine.

It is a further object of this invention to provide an improved catalytic exhaust system for an internal combustion engine when the catalyst bed will be positioned close to the exhaust ports but which will be effectively cooled so as to prevent overheating of the components of the engine.

It is a further object of this invention to provide an improved catalytic exhaust system for an outboard motor that can be easily serviced.

SUMMARY OF THE INVENTION

This invention is adapted to be embodied in an exhaust system for an internal combustion engine having an engine body which has a plurality of exhaust ports opening through a surface of the body member for the exhaust of combustibn products from the cylinders of the engine. The body member surface is enclosed by a cover plate detachably affixed to the body member and which defines a cavity. A combined manifold forming member and catalyst support is received in the cavity and defines with the exhaust ports and body member surface an exhaust gas collector section through which the exhaust gases from the exhaust ports must pass before discharge to the atmosphere.

DETAILED DESCRIPTION OF THE PREFERRED EMBODIMENTS OF THE INVENTION

Figure 1:
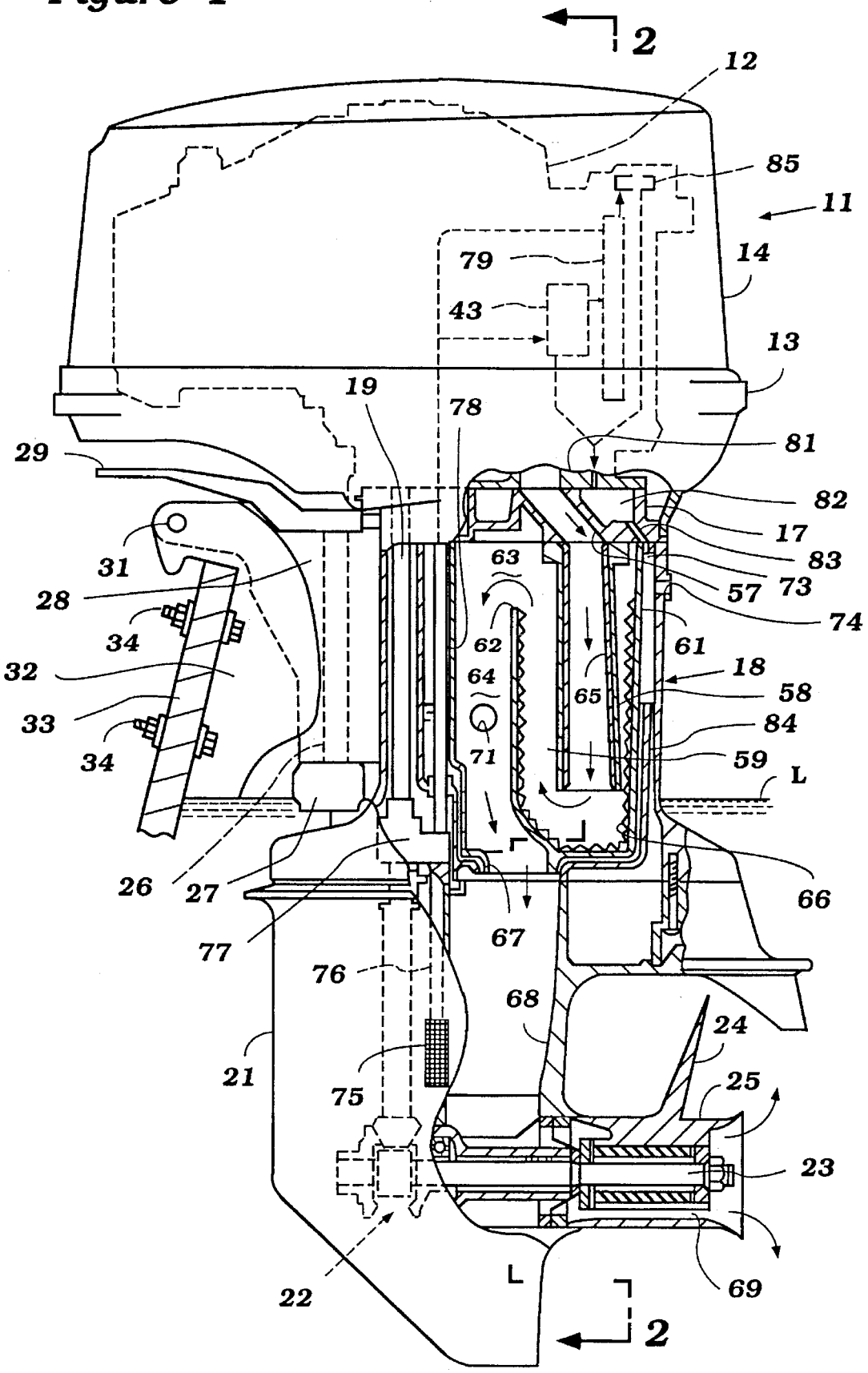
FIG. 1 is a side elevational view of an outboard motor constructed in accordance with a first embodiment of the invention, with portions broken away and shown in section. The outboard motor is shown as being attached to the transom of an associated watercraft, which is shown partially and in cross section.
Figure 2:
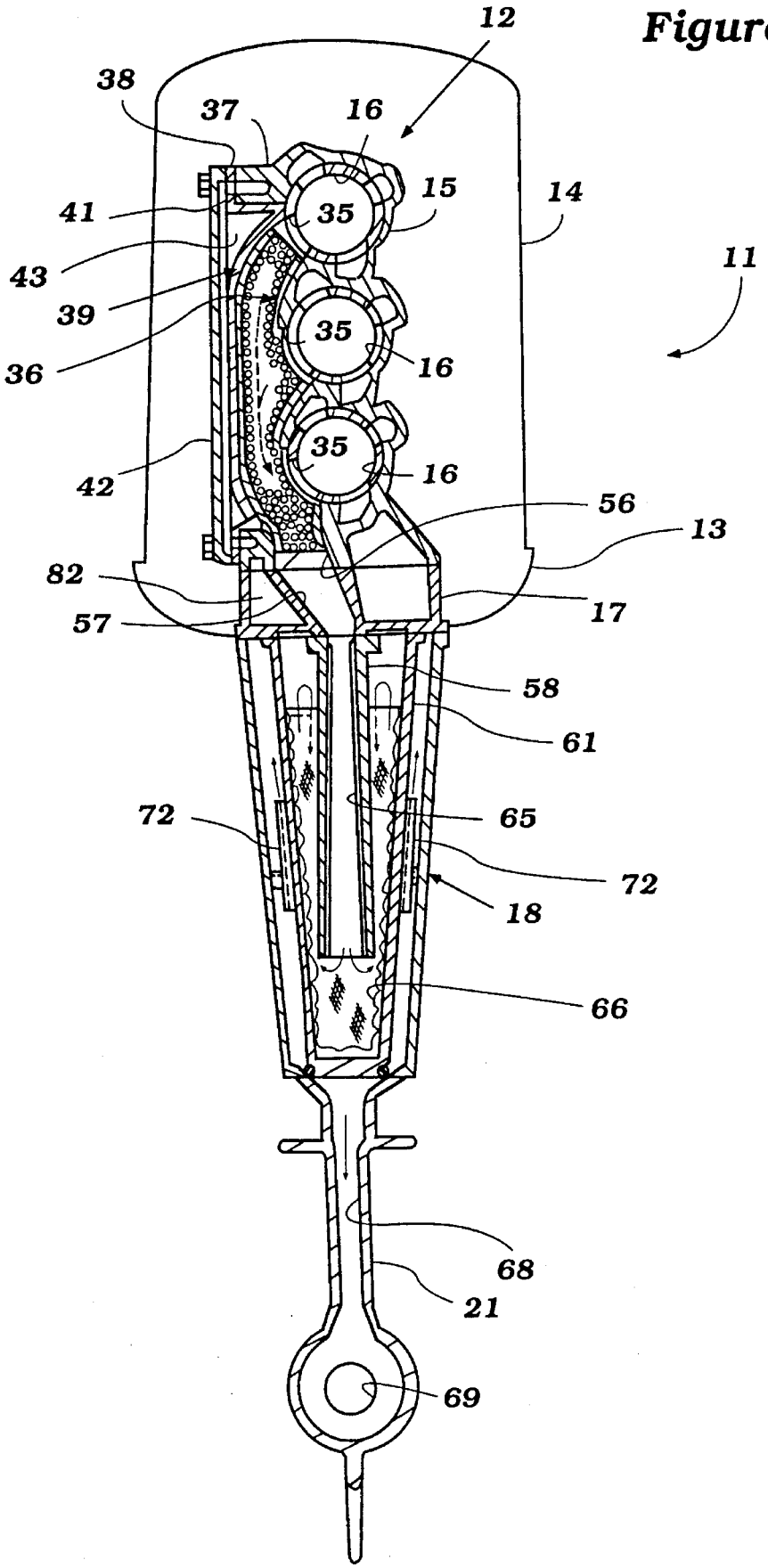
FIG. 2 is a cross-sectional view taken along the line 2—2 of FIG. 1.
Figure 3:
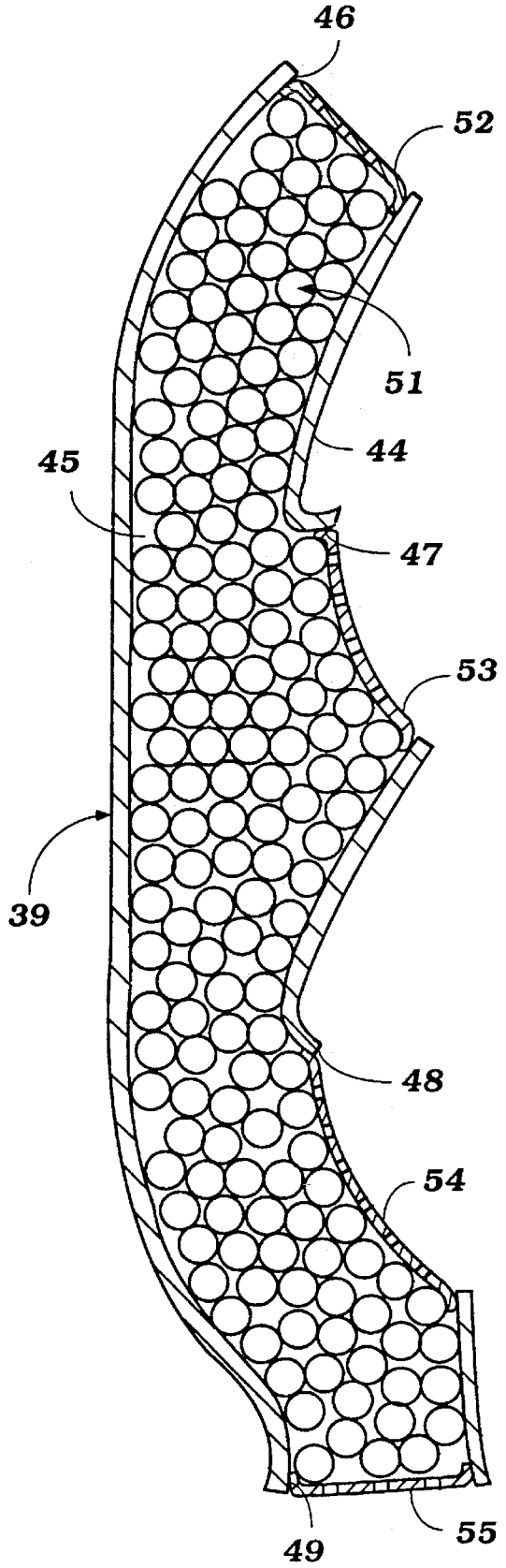
FIG. 3 is an enlarged cross-sectional view taken through the exhaust manifold and catalyst support forming member of this embodiment.

Referring now in detail to the embodiment of FIGS. 1–3 and initially primarily to FIGS. 1 and 2, an outboard motor constructed in accordance with this embodiment of the invention is identified generally by the reference numeral 11. It will be understood that, although the invention is described in conjunction with an outboard motor, the invention may also be used with a wide variety of other types of applications for internal combustion engines. The invention, however, has particular utility in conjunction with outboard motors or marine propulsion units since, as already noted, they present a problem in that their exhaust gases might also pollute the body of water in which the watercraft is operating in addition to the atmosphere. Also, the invention has particular utility in conjunction with two cycle engines and two cycle engines are frequently used as the power source in outboard motors.

The outboard motor 11 includes a power head assembly comprised of an internal combustion engine, indicated generally by the reference numeral 12 and a surrounding protective cowling comprised of a lower tray portion 13 and a detachable main cover portion 14. The engine 12, in the illustrated embodiment, includes a cylinder block 15 having three in-line cylinder bores 16 which are formed by pressed in liners or the like. As is typical with outboard motor practice, the cylinder bores 16 have their axes extending horizontally. Except for the exhaust system of the engine 12, the engine 12 may be considered to be conventional and, for that reason, further details of the construction of the engine 12 are not illustrated and will not be described. Where any details of the engine 12 are not illustrated or described, they may be considered to be conventional. The exhaust system of the engine 12 will be described later after the remainder of the main components of the outboard motor 11 are described.

The engine 12 is mounted on a spacer plate assembly 17 which is formed at and supported upon the upper end of a drive shaft housing, indicated generally by the reference numeral 18. A drive shaft 19 is driven by the output shaft of the engine 12 in a known manner and is journalled suitably within the drive shaft housing 18. A lower unit 21 depends from the drive shaft housing 18 and contains a conventional forward, neutral, reverse transmission 22 for driving a propeller shaft 23 in selected forward and reverse directions. A propeller 24 having a hub portion 25 is suitably affixed to the propeller shaft 23 for rotation with it.

A steering shaft 26 is affixed to the drive shaft housing 18 by means including a lower bracket 27 and an upper bracket (not shown). This steering shaft 26 is suitably journalled for steering movement about a vertically extending steering axis in a swivel bracket 28. A tiller 29 is affixed to the upper end of the steering shaft 26 for steering of the outboard motor 11 in a well known manner.

The swivel bracket 28 is pivotally connected by means of a horizontal tilt pin 31 to a clamping bracket 32 for tilt and trim movement of the outboard motor 11 as is also well known in this art. The clamping bracket 32 has suitable means for affixing it to a transom 33 of an associated watercraft, threaded fasteners 34 being illustrated in this embodiment.

The portion of the outboard motor 11 as thus far described may be considered to be conventional and therefore where any details of the outboard motor are not shown or described they may be considered to be of any conventional nature. As previously noted, the exhaust system of the outboard motor 11 is the area where the invention resides and that exhaust system will now be described by reference to FIG. 3 in addition to FIGS. 1 and 2. The cylinder block 15 and specifically the cylinder liners forming the bore 16 are formed with exhaust ports 35 which are disposed generally on one side of the cylinder block 15 and which open through an outer surface, indicated generally at 36 thereof. This outer surface 36 is surrounded by a peripheral flange 37 having a sealing surface 38.

A combined manifold and catalyst support, indicated generally by the reference numeral 39 is affixed to the cylinder block 16 by means of a hold down plate 42. The hold down plate is held to the cylinder block 12 by a cover plate 42 which only engages the peripheral flange of the hold down plate 41 thus leaving a cooling jacket 43 therearound. Water is circulated through this cooling jacket in a manner which will be described.

Referring now primarily to FIG. 3, the construction of the manifold and catalyst support 39 will be described. It is comprised of an outer shell 44 which may be formed from any suitable material capable of withstanding high temperatures and defines an inner cavity 45 which forms a collector section for the exhaust gases of the engine. The outer shell 44 forms three openings 46, 47, and 48 which are mounted in registry with the exhaust port 35 of the cylinder block 15 so that all of the exhaust gases which flow out of the exhaust ports 35 must enter the collector section 45 through the openings 46, 47, and 48. These exhaust gases then flow downwardly through a discharge opening 49 formed in the lower face of the outer housing 44.

In accordance with this embodiment of the invention, a catalyst bed, indicated generally by the reference numeral 51 is positioned within the collector section 45 and this catalyst bed 51 in this illustrated embodiment comprises a plurality of spherical balls which have their exterior surface coated with the desired type of catalytic material. To hold these catalyst balls in place, perforated closure plates 52, 53, 54, and 55 extend across the openings 46, 47, 48, and 49, respectively. It should be readily apparent that this combined manifold forming member and catalyst bed 39 may be readily removed for servicing by removing the cover plate 42 once the main protective cowling member 14 is removed.

Referring now primarily to FIGS. 1 and 2, the manifold and catalyst bed forming member 39 and specifically its outer shell 44 is fitted around the discharge opening 49 into an exhaust passage 56 formed in the lower face of the cylinder block 15. This exhaust passage 56 mates with a corresponding exhaust passage 57 formed in the spacer plate 17 so that the exhaust gases from the engine may be discharged downwardly into the drive shaft housing 18.

An exhaust pipe 58 is mounted on the underside of the spacer plate 17 and conveys the exhaust gases downwardly into a first expansion chamber 59 formed in the drive shaft housing 18. This first expansion chamber 59 is formed at least in part by an expansion chamber forming member 61 that is affixed in any suitable manner within the drive shaft housing 18. It should be noted that the lower end of the exhaust pipe 58 terminates at a point slightly above the water level indicated by the line L when the watercraft is operating at low speeds or is idling.

With conventional exhaust system constructions, this can present some problems because, as is well known, there may be negative pulses in the exhaust gases which could cause water to be drawn from the expansion chamber 59 upwardly into the engine through its exhaust ports through the exhaust system as thus far described. However, in accordance with a feature of the invention, the expansion chamber 59 is defined on one side by a vertically extending wall 62 that terminates at the upper end of the drive shaft housing 18 and thus forms an exhaust gas passage 63 that extends generally horizontally in a fore and aft direction. Hence, the exhaust gases must flow upwardly from the expansion chamber 59 across the passageway 63 to reach a further expansion chamber 64 formed on the outer side of the wall 62. This acts as a trap to prevent water from flowing from the underwater exhaust gas discharge, to be described, back to the engine through its exhaust port.

In addition to the catalyst bed 51 formed in the manifold and catalyst support 39 the inner surface of the exhaust pipe 58 is also treated or lined with a catalytic material 65 which may be of the same or of a different type than that employed in the exhaust manifold 39 and thus affords further treatment of the exhaust gases. In addition, the inner wall of the expansion chamber 59 may also be formed with a lining 66 of a suitable catalytic material for further treatment of the exhaust gases.

From the expansion chamber 64 the exhaust gases flow downwardly through an opening 67 formed in the lower end of the drive shaft housing to an exhaust gas passage 68 that is formed in the lower unit 21. This passage 68 communicates with a through the hub exhaust gas discharge 69 so that the exhaust gas may be discharged to the atmosphere through the body of water in which the watercraft is operating.

This underwater exhaust gas discharge 69 is effective when the watercraft is operating at a high speed or planing and the water level is at a lower level than the level L. However, when the engine is idling or running slowly, there will be low exhaust gas pressure and also a high head of water so that the exhaust gases cannot exit in this manner. There is, therefore, provided an above the water exhaust gas discharge which, in accordance with a feature of the invention, is disposed so that all of the exhaust gases will pass through the catalyst beds 51, 65, and 66 before exiting through this discharge. This comprises a pair of aligned openings 71 formed in opposing walls of the expansion chamber forming member 69 and which are covered by baffle plates 72 so that the exhaust gases will flow out of the opening 71 upwardly through the baffle 72 into a further chamber 73 formed outside of the expansion chamber forming member 61. These exhaust gases then can exit through an above the water low speed exhaust gas discharge 74 which is above the water level under all normal running conditions of the watercraft. However, this exhaust path is more restricted than the underwater exhaust gas discharge path and hence the exhaust gases will not flow to any significant extent out the discharge 74 when operating at high speed so as to ensure against any loss of silencing.

The engine 12 is water cooled and water for its cooling is drawn through an underwater inlet 75 formed in a side of the lower unit 21. A delivery conduit 76 extends upwardly through the lower unit 21 to a water pump 77 that is positioned at the interface between the drive shaft housing 18 and lower unit 21. This water pump is driven from the drive shaft 19 in a well known manner. Water then is delivered upwardly to the engine through a supply conduit 78 and circulates in parallel flow paths through a cylinder head cooling jacket 79 (shown schematically only in FIG. 1) and through the cooling jacket 43 for the exhaust manifold and catalyst support 39. After the coolant has flown through the cooling jacket 43 it may flow either in part to the cylinder head cooling jacket 79 or be returned along with the other engine coolant through a small weep hole 81 formed in the lower face of the cylinder block 15 and which communicates with a cooling jacket 82 formed in the spacer plate 17 around its exhaust passage 57.

This coolant is then discharged through a further path 83 to a water jacket formed by a water jacket forming member 84 contained within the drive shaft housing 18 and around the expansion chamber forming member 61. Coolant spills over an upper wall of this water jacket forming member 84 back into the lower unit for discharge to the body of water in which the watercraft is operating in a well known fashion.

The cooling system for the engine 12 further includes a valve assembly 85 that combines a thermostatically controlled valve and a pressure responsive valve, as is well known in outboard motor practice. This assembly also discharges water back to the lower unit through the weep hole 81 and other discharge paths thus far described.

Figure 4:
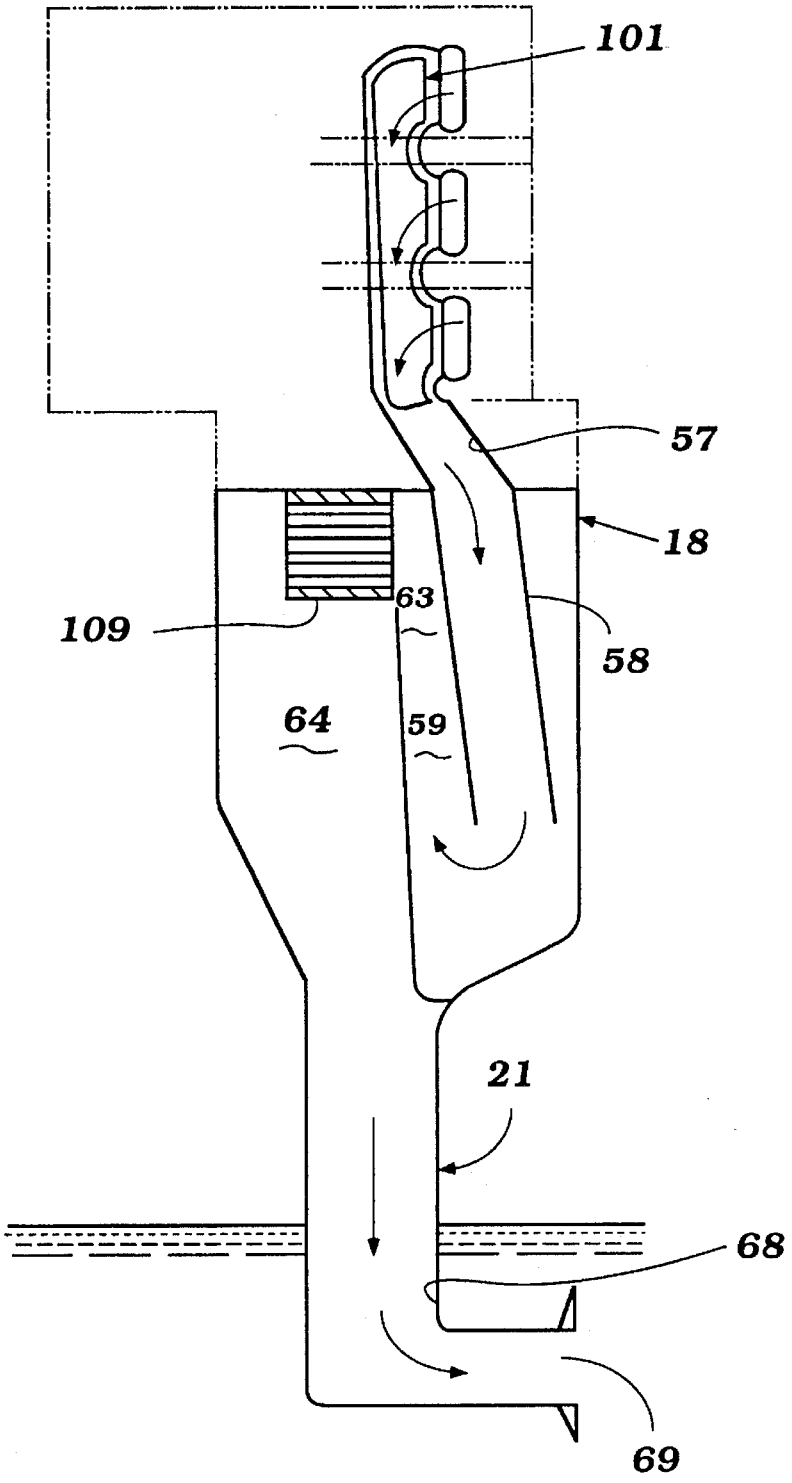
FIG. 4 is a partially schematic view, in part similar to FIG. 1, showing an outboard motor constructed in accordance with another embodiment of the invention.
Figure 5:
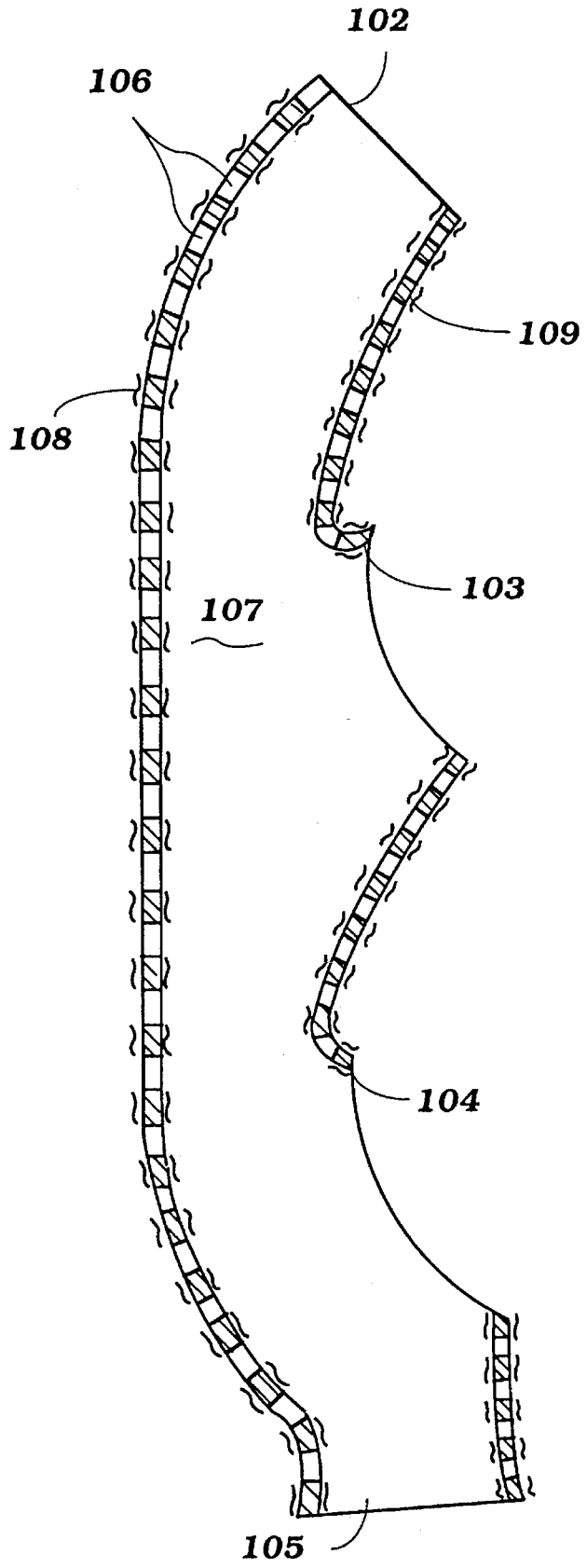
FIG. 5 is an enlarged cross-sectional view taken through the exhaust manifold and catalyst support forming member of this embodiment.
Figure 6:
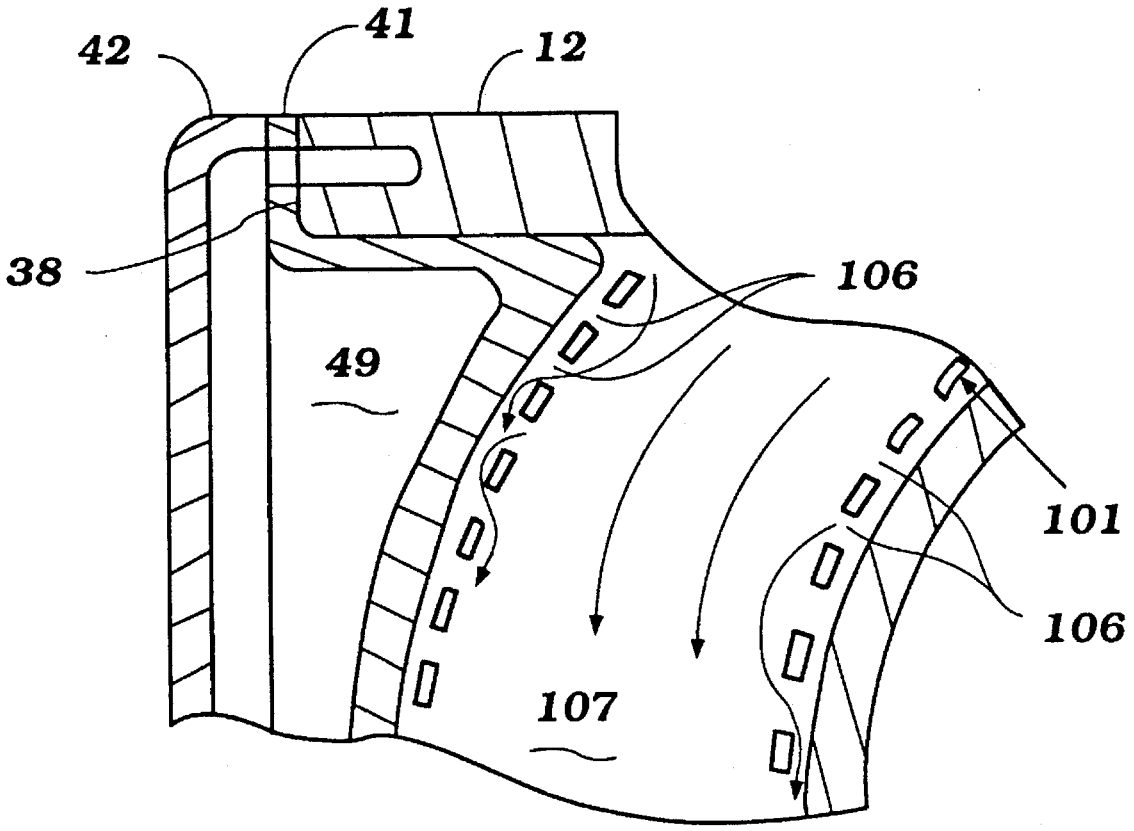
FIG. 6 is an enlarged cross-sectional view showing how the exhaust gases flow through and around the catalyst support in this embodiment.

FIGS. 4–6 show another embodimentof the invention which differs from the embodiment of FIGS. 1–3 only in the way in which the manifold and catalyst support is configured and also in the different location of the catalyst bed in the drive shaft housing. Since these are the only differences from the previously described embodiment, components of this embodiment which are the same as those previously described are identified by the same reference numerals and will not be described again, except for their interrelation with the components of this embodiment. For the same reason, the components, except for those which form the major portion of the differences in this embodiment are shown primarily only in a schematic fashion.

In this embodiment, an exhaust manifold and catalyst bed forming member, indicated generally by the reference numeral 101 is supported within the cavity of the cylinder block 12 in the same manner as with the previously described embodiment. This member 101 is formed from an outer shell having a tube-like configuration having openings 102, 103, and 104 that are supported in engagement with the exhaust ports 35 of the cylinder block as with the previously described embodiment. In addition, a downwardly facing discharge opening 105 communicates with the passage 56 formed in the lower face of the cylinder block 12. In this embodiment, however, the member 101 is formed with a plurality of perforated openings 106 along its entire length so that the inner peripheral volume 107 thereof can have exhaust gases flow not only through this volume 107 to the discharge opening 105 but also through these openings 106. The bridging area between the openings 106 is coated with a catalyst material 108 so that the flow of the exhaust gases is not truly through the support but because of the configuration the exhaust gases will flow not only through the interior cavity 107 but also through the openings 106 as shown by the arrows in FIG. 6 so as to ensure good and complete exhaust gas treatment.

There is further provided in the trap section 63 a catalyst bed, indicated generally by the reference 109 through which the exhaust gases will pass for their further treatment. Thus, complete exhaust treatment is ensure while retaining the advantages of the embodiment of FIGS. 1–3.

Figure 7:
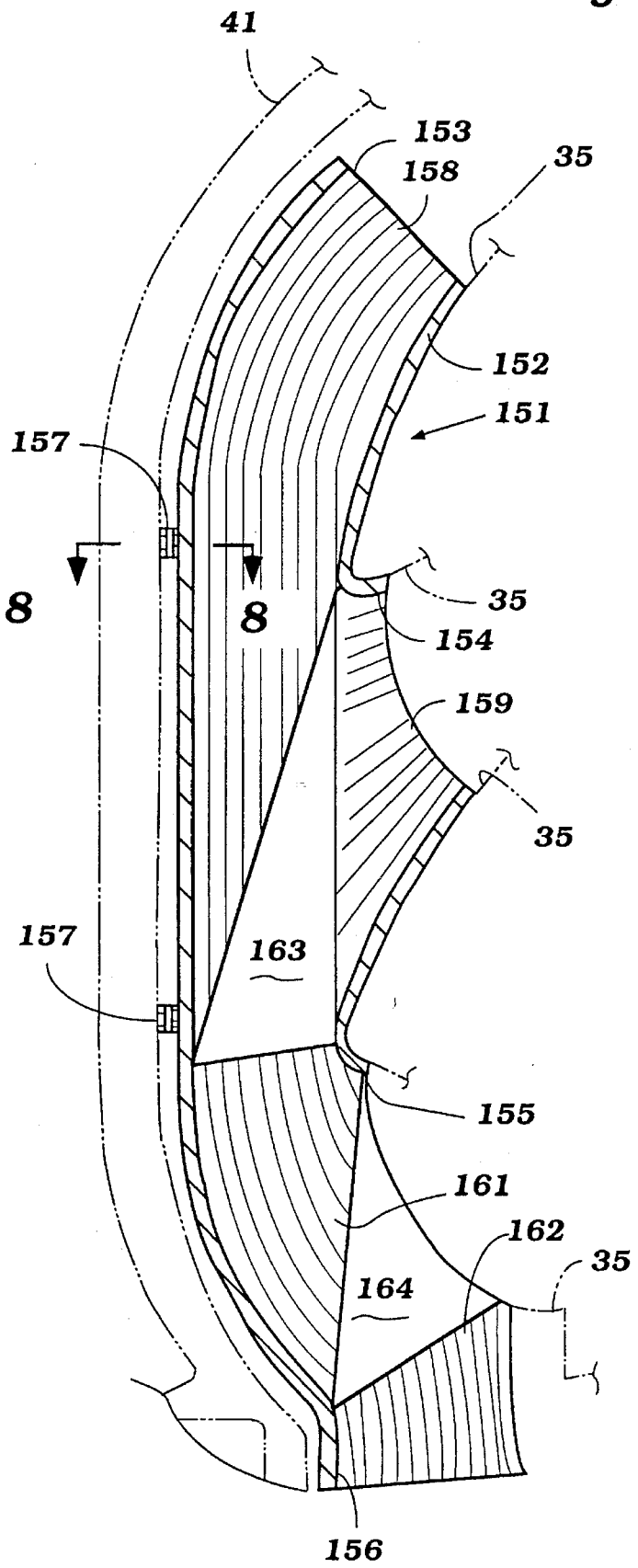
FIG. 7 is a cross-sectional view, in part similar to FIGS. 3 and 5 and shows a combined exhaust manifold and catalytic support forming member constructed in accordance with another embodiment of the invention.
Figure 8:
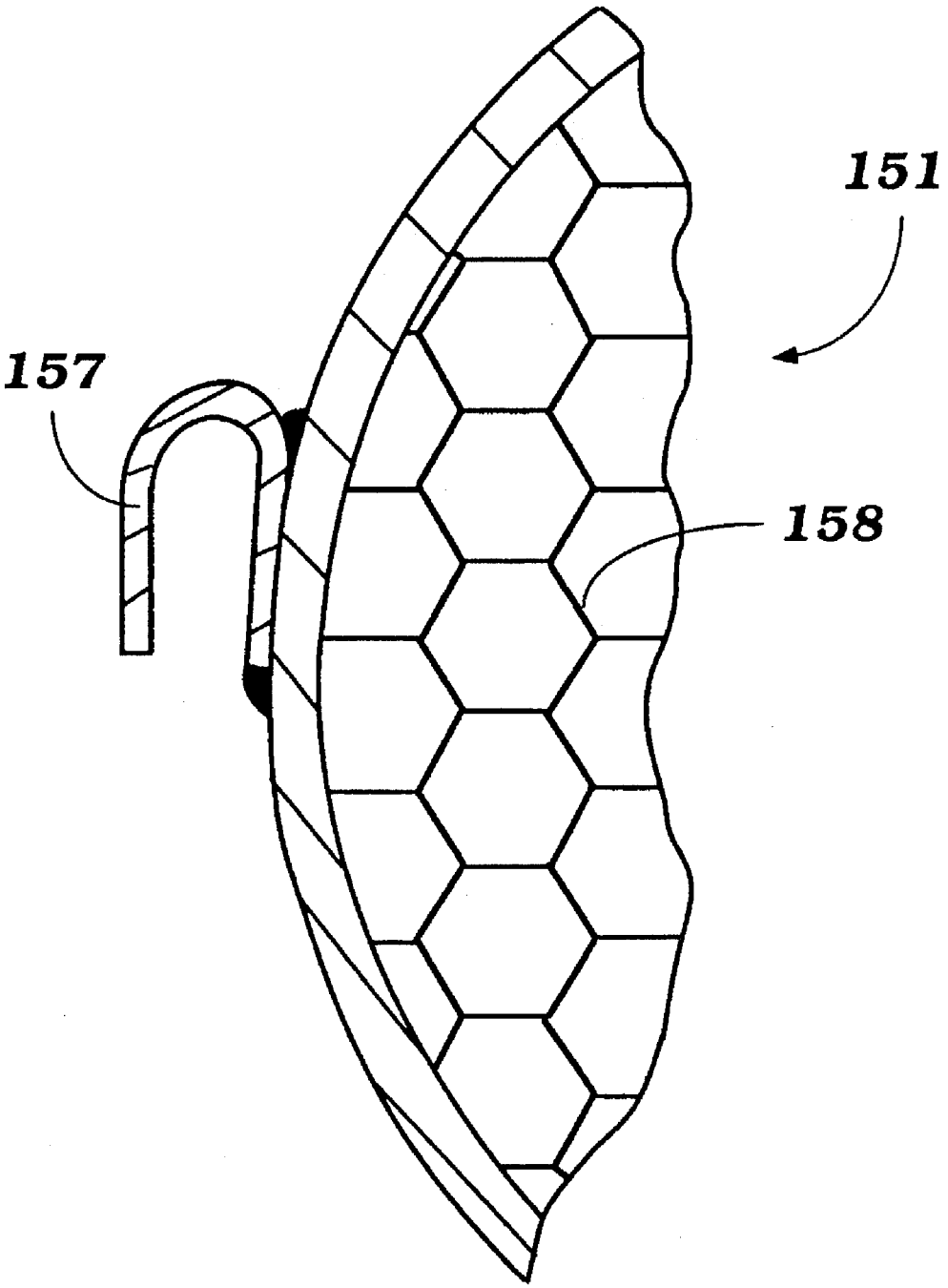
FIG. 8 is an enlarged cross-sectional view taken along the line 8—8 of FIG. 7.

Another embodiment of the invention is shown in FIGS. 7 and 8 and this embodiment differs from the previously described embodiments only in the way in which the manifold and catalyst support is formed and is supported. Because of this, only this member is shown in FIGS. 7 and and is identified generally by the reference numeral 151. The member 151 is formed of an outer housing 152 having openings 153, 154, and 155 which communicate with the respective cylinder block exhaust ports 35 as with the previously described embodiments. These exhaust ports are shown partially and in phantom for orientation purposes. In addition, there is formed a discharge opening 156 which communicates with the cylinder block exhaust discharge passage 56, also like the previously described embodiments.

In this embodiment, rather than the hold down plate 41 directly engaging the outer housing, the outer housing 152 is formed with a plurality of U-shaped tabs 157 that are affixed to as by welding or the like and which are engaged by the hold down plate 41. These tabs 157 have resilience so as to permit some flexure and transverse movement as well as allowing for thermal expansion.

In this embodiment, a series of honeycomb type catalyst bed sections 158, 159, 161, and 162 are placed in the outer housing 152. The section 158 extends from the inlet opening 153 down to a partially overlying area with the inlet openihg 154 but defining a void 163 between the bed 158 and the bed 159. This void permits a lesser degree of resistance to exhaust gas flow and also will reduce somewhat the amount of total heat. In a similar manner, there is provided a void area 164 in the area of the opening 155 but the exhaust gases flowing from the lowermost exhaust port will pass through the bed 162 for effective treatment.

Figure 9:
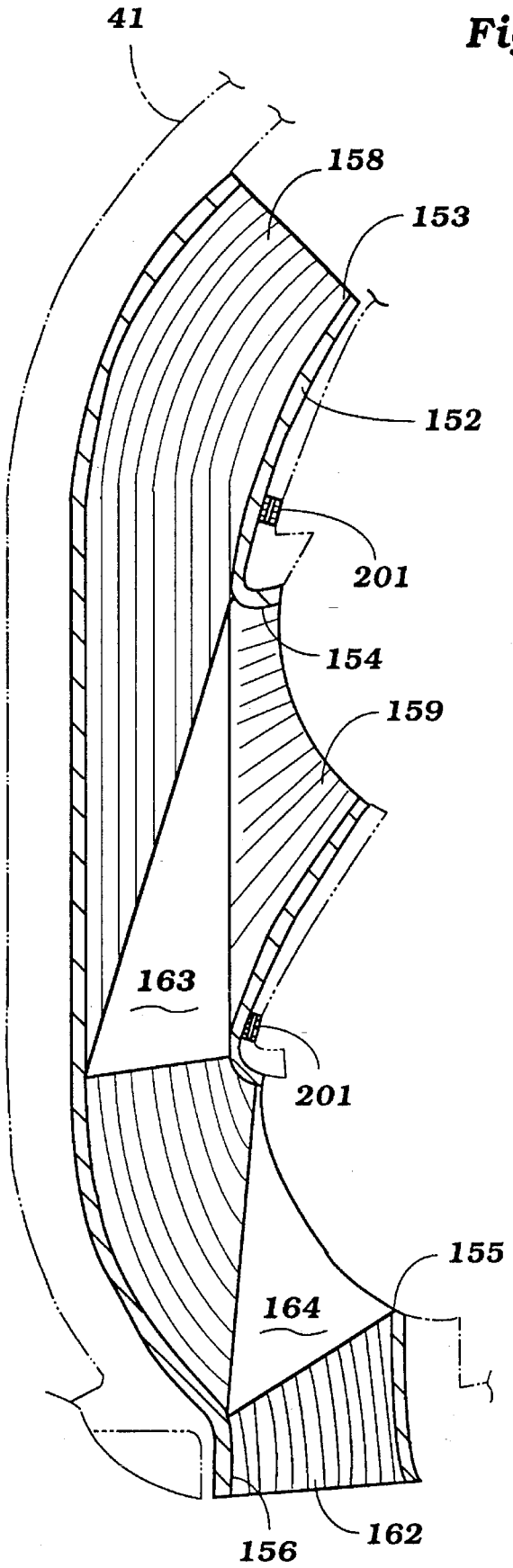
FIG. 9 is an enlarged cross-sectional view, in part similar to FIGS. 3, 5, and 7 and shows a still further embodiment of the invention.

FIG. 9 shows another embodiment which is the same as the embodiment of FIG. 7 but in this embodiment, the resilient tabs 157 between the outer housing 152 and the hold down plate 41 are eliminated. Hence, the hold down plate 41 directly engages the surface of the outer housing 152. However, resilient tabs 201 of the same configuration are interposed between the inner side of the housing 152 and the cylinder block surface 36 so as to afford resilience and accommodate thermal expansion without adding undue stresses. In addition, some vibration damping will be afforded by this arrangement.

It should be readily apparent from the foregoing description that the described embodiments of the invention provide very effective catalytic treatment for the exhaust gases of an internal combustion engine without causing overheating of the basic components of the engine while at the same time offering ease of servicing. Of course, the foregoing description is that ofthe preferred embodiments of the invention and various changes and modifications may be made without departing from the spirit and scope of the invention, as defined by the appended claims.

We claim:

1. An exhaust system for an internal combustion engine comprising an engine body member having a plurality of exhaust ports opening through a surface of said body member for exhaust of combustion products from cylinders of said engine, said body member surface defining a cavity enclosed by a cover plate detachably affixed to said body member, a manifold forming member received in said cavity, said manifold forming member being comprised of an outer shell having qenerally tubular inner surface supporting a catalyst material for contact with exhaust gases passing through said manifold forming member and defining with said exhaust ports and said body member surfaces an exhaust collector section through which exhaust gases from said exhaust ports must pass before discharge to the atmosphere, said manifold forming member consisting of a plurality of inlet sections, each supporting a catalyst bed therein and adapted to cooperate with a respective one of said exhaust ports to receive the exhaust gases therefrom and catalytically treat such exhaust gases, and an outlet section adapted to communicate with an exhaust discharge system for the engine.

2. The exhaust system as set forth in claim 1, wherein the catalyst completely fills the manifold forming member.

3. The exhaust system as set forth in claim 1, wherein the catalyst comprises a bed comprised of a plurality of spaced apart sections with voids between adjacent sections for increased air flow and cooling.

4. The exhaust system as set forth in claim 1, wherein the manifold forming member comprises a perforated pipe section.

5. The exhaust system as set forth in claim 4, wherein the catalyst is supported on the inside and outside of the perforated pipe and the exhaust gases can flow through the perforations for contact with the inside and outside catalyst bed.

6. The exhaust system as set forth in claim 1, further including resilient means for supporting the manifold forming member within the cavity.

7. The exhaust system as set forth in claim 6, wherein the resilient means is interposed between the cover plate and the manifold forming member.

8. The exhaust system as set forth in claim 6, wherein the resilient means is interposed between the engine body member surface and the manifold forming member.

9. The exhaust system as set forth in claim 1, wherein the cover member defines a cooling jacket through which liquid coolant for the engine may be circulated for cooling the manifold forming member and catalyst.

10. The exhaust system as set forth in claim 9, wherein a resilient means is interposed between the cover plate and the manifold forming member for supporting at least in part said manifold forming member.

11. The exhaust system as set forth in claim 9, wherein a resilient means is interposed between the engine body member surface and the manifold forming member for supporting said manifold forming member.

12. An outboard motor embodying an internal combustion engine and exhaust system as set forth in claim 1 in the power head thereof and further including a drive shaft housing and lower unit depending from the power head and containing a propulsion device driven by the engine for propelling an associated watercraft through the body of water in which the watercraft is operating.

13. The outboard motor as set forth in claim 12, further including an expansion chamber formed in the drive shaft housing and means for delivering exhaust gases from the combined manifold forming member and catalyst bed to said expansion chamber.

14. The outboard motor as set forth in claim 13, further including a further catalyst bed positioned in the drive shaft housing and lower unit and through which the exhaust gases must pass prior to escape to the atmosphere.

15. The outboard motor as set forth in claim 14, wherein the means for delivering exhaust gases to the expansion chamber comprises an exhaust pipe.

16. The outboard motor as set forth in claim 14, wherein the further catalyst bed is positioned in the expansion chamber.

17. The outboard motor as set forth in claim 15 wherein the further catalyst bed is formed in the exhaust pipe.

18. The outboard motor as set forth in claim 13, wherein there are a pair of expansion chambers formed in the drive shaft housing with a trap section interconnecting them above the highest water level anticipated during the use of the outboard motor when attached to the transom of a watercraft.

19. The outboard motor as set forth in claim 18, wherein a further catalyst bed is positioned in the trap.

20. The exhaust system as set forth in claim 12, wherein the catalyst comprises a catalyst bed completely filling the manifold forming member.

21. The exhaust system as set forth in claim 12, wherein the catalyst comprises a plurality of spaced apart sections with voids between adjacent sections for increased air flow and cooling.

22. The exhaust system as set forth in claim 12, wherein the manifold forming member comprises a perforated pipe section.

23. The exhaust system as set forth in claim 22, wherein the catalyst bed is formed on the inside and outside of the perforated pipe and the exhaust gases can flow through the perforations for contact with the inside and outside catalyst.

24. The exhaust system as set forth in claim 13, further including resilient means for supporting the manifold forming member within the cavity.

25. The exhaust-system as set forth in claim 24, wherein the resilient means is interposed between the cover plate and the manifold forming member.

26. The exhaust system as set forth in claim 24, wherein the resilient means is interposed between the engine body member surface and the manifold forming member.

27. The exhaust system as set forth in claim 13, wherein the cover member defines a cooling jacket through which liquid coolant for the engine may be circulated for cooling the manifold forming member and catalyst.

28. The exhaust system as set forth in claim 27, wherein a resilient means is interposed between the cover plate and the manifold forming member for supporting the manifold forming member.

29. The exhaust system as set forth in claim 27, wherein a resilient means is interposed between the engine body member surface and the manifold forming member for supporting the manifold forming member.

* * * * *